US005365811A

United States Patent [19]

Chi

[11] Patent Number: 5,365,811

[45] Date of Patent: Nov. 22, 1994

[54] MULTIPURPOSE IN-LINE SKATE TOOL

[76] Inventor: Clive H. Chi, 10573 W. Pico Blvd., Ste. 283, Los Angeles, Calif. 90064

[21] Appl. No.: 83,950

[22] Filed: Jun. 28, 1993

[51] Int. Cl.[5] ..... B25B 23/00

[52] U.S. Cl. ..... 81/439; 81/125.1; 81/437; 7/165

[58] Field of Search ..... 7/138, 165, 170; 81/125.1, 437–439, 124.4, 124.6, 57.5

[56] References Cited

U.S. PATENT DOCUMENTS

| | | | |
|---|---|---|---|
| 1,168,185 | 1/1916 | Fleck | 81/125.1 |
| 3,742,533 | 7/1973 | Brunette | 7/165 |
| 4,467,677 | 8/1984 | Grifford | 7/165 |
| 4,744,736 | 10/1988 | Brawner et al. | 7/165 |
| 5,018,411 | 5/1991 | LaPadura | 81/437 X |
| 5,186,083 | 2/1993 | Hsiao | 81/125.1 |

OTHER PUBLICATIONS

Rollerblade ® Blade Tool TM —distributed by Rollerblade, Inc., 5101 Shady Oak Rd., Minneapolis, Minn. 55343 (photo copy of packaging).

*Primary Examiner*—D. S. Meislin

[57] ABSTRACT

A single unit multipurpose hand tool structured to allow for the manual manipulating of fasteners and the removal of wheel bearings on in-line roller skates. The multipurpose tool includes a rigid plastic center handle structured generally of a three armed star having flattened distal ends from which metal tool tips extend. The center handle includes curving sides connecting each arm so as to provide smooth curved surfaces which comfortably fit the human hand and thereby allow high manual rotational leveraging of the tool tips when manipulating fasteners. The multipurpose tool provides a flat head screw driver, a hex key, and a phillips screwdriver having an adjacent wheel bearing pusher having two abutment shoulders, and thereby the compact and lightweight tool provides all of the most commonly needed tools associated with the maintenance of in-line roller skates.

1 Claim, 6 Drawing Sheets

MULTIPURPOSE IN-LINE SKATE TOOL

BACKGROUND OF THE INVENTION

1. Field of the Invention

The present invention relates to hand tools used in the adjusting, repairing or replacing of parts on in-line roller skates, and more precisely to a single multipurpose hand tool which provides all of the most commonly needed various tools associated with the maintenance of in-line skates.

2. Description of the Prior Art

Roller skates having multiple wheels all endwardly aligned in a straight row, commonly known as in-line skates, have become increasingly popular in the last few years. The majority of wheels on in-line skates are comprised of a urethane, which is relatively durable but still susceptible to wear. One typical problem experienced with in-line skates involves uneven wear on the inside edge of the plastic wheels due to the skater pushing outward and back on the skates to gain forward movement. The wear is quite significant when the in-line skates are used on rough, abrasive surfaces such as asphalt and concrete. The eventual result of the inside edge of the wheels wearing down more rapidly than the outside edges, is that the normally rounded surface area of the wheel which contacts the riding surface is now uneven and therefore the wheels cannot grip the road as efficiently. This can create an unpleasant vibratory effect and generally results in the skates becoming harder to maneuver and control, especially in turns. To avoid this condition the wheels should be periodically rotated or turned over, to ensure even wear on both edges of the wheels. This rotation includes rotating each wheel 180 degrees end over end, and wheels 1 and 3 being switched in position, and wheels 2 and 4 being switched in position. This rotation greatly extends the lifetime and performance of the wheels. Skaters therefore often rotate the wheels on a regular basis, which for some enthusiasts can even include several rotations per day. This wheel rotation procedure requires the removal of the wheel axle(s), and this requires one or more tools, and therefore the skater must either return to a location where the specific tools are available, or to carry the tools with him.

In-line skates additionally include rubbery brake pads, usually attached to the rear of each skate, and which the rider can press against the riding surface in order to slow down or stop. These brake pads wear out, and are therefore mounted with removable fasteners which require tools to allow the periodic replacement thereof.

Another reason for an in-line skater to need a tool is in the event of an untimely loosening of one of the wheel axles during skating, and this is relatively common.

It is for the above reasons that the in-line skater should keep tools close to him, such as in his pocket, car, or fanny pack or back pack, and it is believed that a single multipurpose tool would be more convenient to carry compared to multiple individual tools. Therefore, there is a definite need for providing a compact and lightweight multipurpose tool which is easily portable by the skater, with which to make wheel rotations and minor repairs on in-line roller skates. This needed multipurpose tool would ideally be structured in a manner which provides all of the most commonly needed tools associated with the maintenance of in-line skates, and further in a manner which keeps the various tools organized to prevent them from being misplaced. Ideally, this needed tool would additionally be very durable and relatively inexpensive, so as to provide good value to the skater.

SUMMARY

The present invention is a versatile hand tool for the removal of wheel bearings and the manipulation of the various fasteners found on in-line roller skates. My multipurpose hand tool is provided in a one piece unit which can be easily transported on the skater or stored in a small space. The present tool is lightweight, compact, highly durable, and relatively inexpensive to manufacture. My in-line skate tool includes the four most commonly needed tools associated with wheel bearings and the various fasteners found on the various brands of in-line skates currently on the market. The four tools are affixed in the one compact unit, and thereby the possibility of misplacing a needed tool is eliminated. In-line skates are manufactured by several different manufacturers, and these various manufacturers utilize varying types of fasteners on their skates. The present in-line skate tool provides a sufficient number of fastener gripping or manipulating tools to allow the repair, adjustment or disassembly of almost all in-line skates currently on the market. The four tools include a #2 phillips screw driver, a ¼ straight blade or flat head screw driver, a 5/32" hex key (allen wrench), and a shouldered bearing pusher structured for removing the wheel bearings from the wheels. My in-line skate tool provides these four particular tools incorporated into three tool tips affixed to a common center handle. The #2 phillips screw driver and the bearing pusher are both incorporated onto the same tool tip, with the bearing pusher including slightly enlarged abutment shoulders positioned several millimeters apart and down from the distal end of the phillips screw driver. A smooth portion of the shaft having the phillips tip serves as a centering guide and stabilizing shaft for the adjacent bearing pushing shoulder.

The three tool tips are inherently formed onto the distal ends of three separate, short cylindrical metal rods. The ends of the three cylindrical metal rods are covered with plastic which defines the central plastic handle. The metal rods are preferably manufactured of a hardened tool steel, such as chrome vanadium, which resists rust and corrosion. The plastic handle is generally structured in the form of a three armed star, with each of the three tool tips projecting outward from the distal ends of the plastic arms. The attachment ends of the rods within the plastic handle, opposite to the tool tips, are also structured to prevent twisting of the cylindrical rods within the plastic handle. Preferably the handle is comprised of a rigid plastic which is injection molded over and in intimate contact with the attachment ends of the three separate metal rods. Alternatively, the attachment or inwardly positioned ends of the metal rods could be affixed together by welding to form a single three armed metal unit around which the plastic handle is molded, and in this case the finished tool would appear identical, however, this would be slightly more expensive, and the arrangement described in this disclosure is more than adequate from a strength standpoint since the present design can withstand 30 ft-lbs torque.

The four specific tools incorporated into my in-line skate tool are compatible with approximately ninety percent of the in-line skates manufactured today. Most of the commonly used in-line skates require a 5/32" hex key for removal of the wheel axle, and a flat head screw driver or a #2 phillips screw driver for the brake pad attachment screw. A few of the other in-line skates require a flat head screw driver for removal of the axle. Therefore, the in-line skate tool includes these three specifically sized tools, one of which is structured for removing the wheels and brake pads of most in-line skates available on the market today. The bearing pusher of my in-line skate tool is structured for removing the wheel bearings of all existing makes and models of in-line skates, since the wheel bearings are all standardized. Therefore, the in-line skate tool is structured for use with the majority of in-line skates, which is extremely convenient for the user since he does not have to buy a specific type or model of in-line tool to fit his particular skates. Additionally, he will also probably not have to replace the tool if he purchases other skates.

The plastic handle, with affixed metal tool tips, is sized and shaped for providing an easily gripped handle which is comfortable for the user to manipulate, allowing him high rotational leverage. Two of the three arms when positioned in the palm of the user's hand provide sufficient leverage for substantial torquing of the third tool tip which would be extending outward between the user's fingers. The in-line skate tool can also be conveniently carried with the skater while he skates since the tool is small, lightweight, generally flat, and fits easily into the commonly used hip pouches or even a jacket or pants pocket. This allows the skater the freedom to do repairs on the spot, or to rotate the wheels any time he chooses, therefore allowing him to rotate them more often which extends the life of the wheels.

Other possible uses of the in-line skate tool include adjustment of accessory sporting equipment associated with in-line roller skates or skating. A sport similar to ice hockey has developed around the use of in-line skates utilizing helmets and hockey sticks. Helmets sometimes need adjustments for proper fit and hockey blades occasionally need replacement, with these procedures also being performed with the use of the in-line skate tool.

Even if the skater chooses not to transport the tool on his person, the in-line skate tool is still convenient in that when stored with other conventional tools, the in-line skate tool can be readily and easily distinguished from the other tools stored in a tool box. Once it is retrieved, the user knows he has all the properly sized tools he needs to work on his skates. Time is therefore saved in that there is no need to search for all the individual appropriately sized tools, which more often than not, are not all stored in the same precise location.

DESCRIPTION OF THE PREFERRED EMBODIMENT

Figure 1:
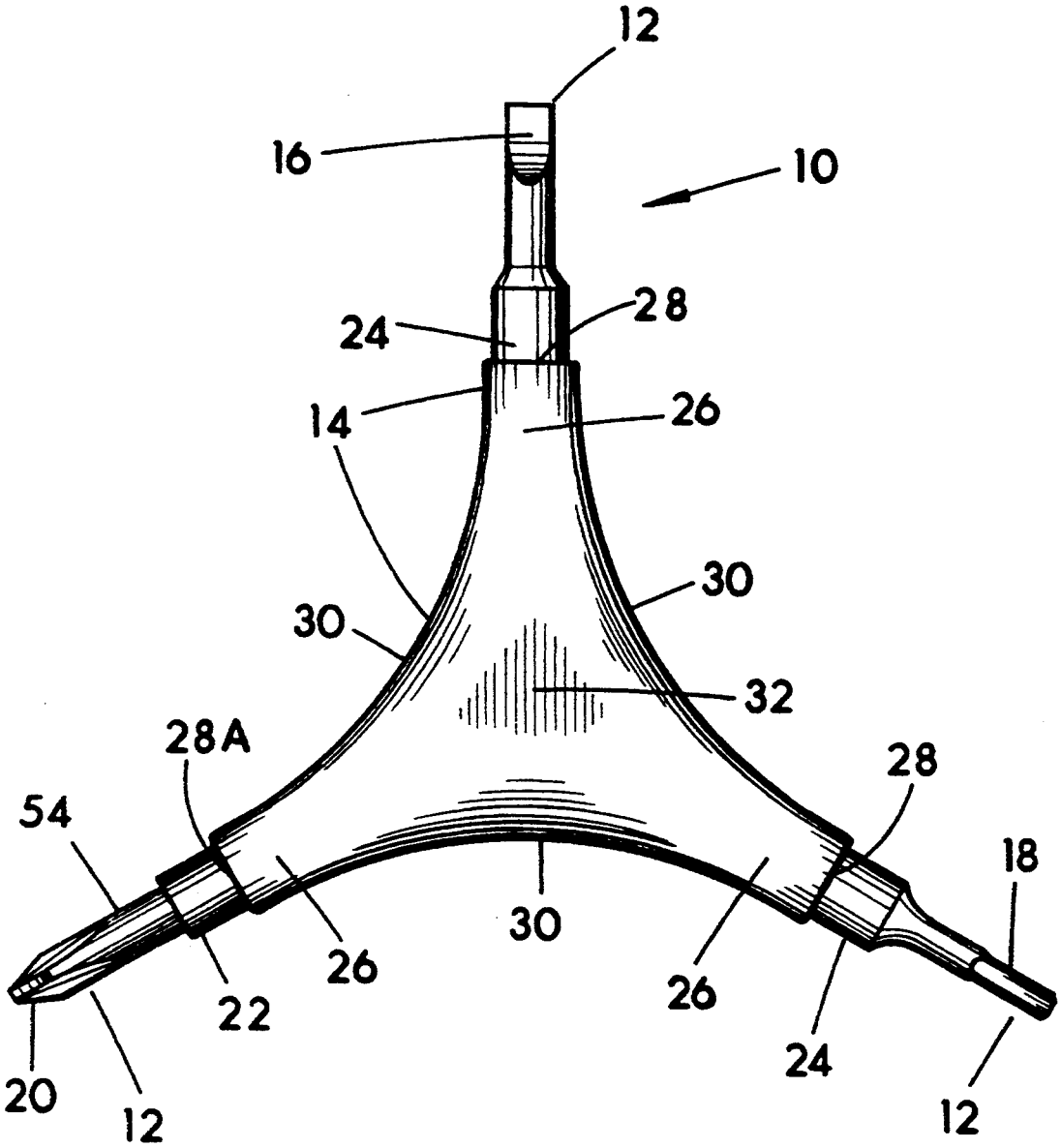
FIG. 1 is a front elevational view of a preferred embodiment of my in-line skate tool.
Figure 2:
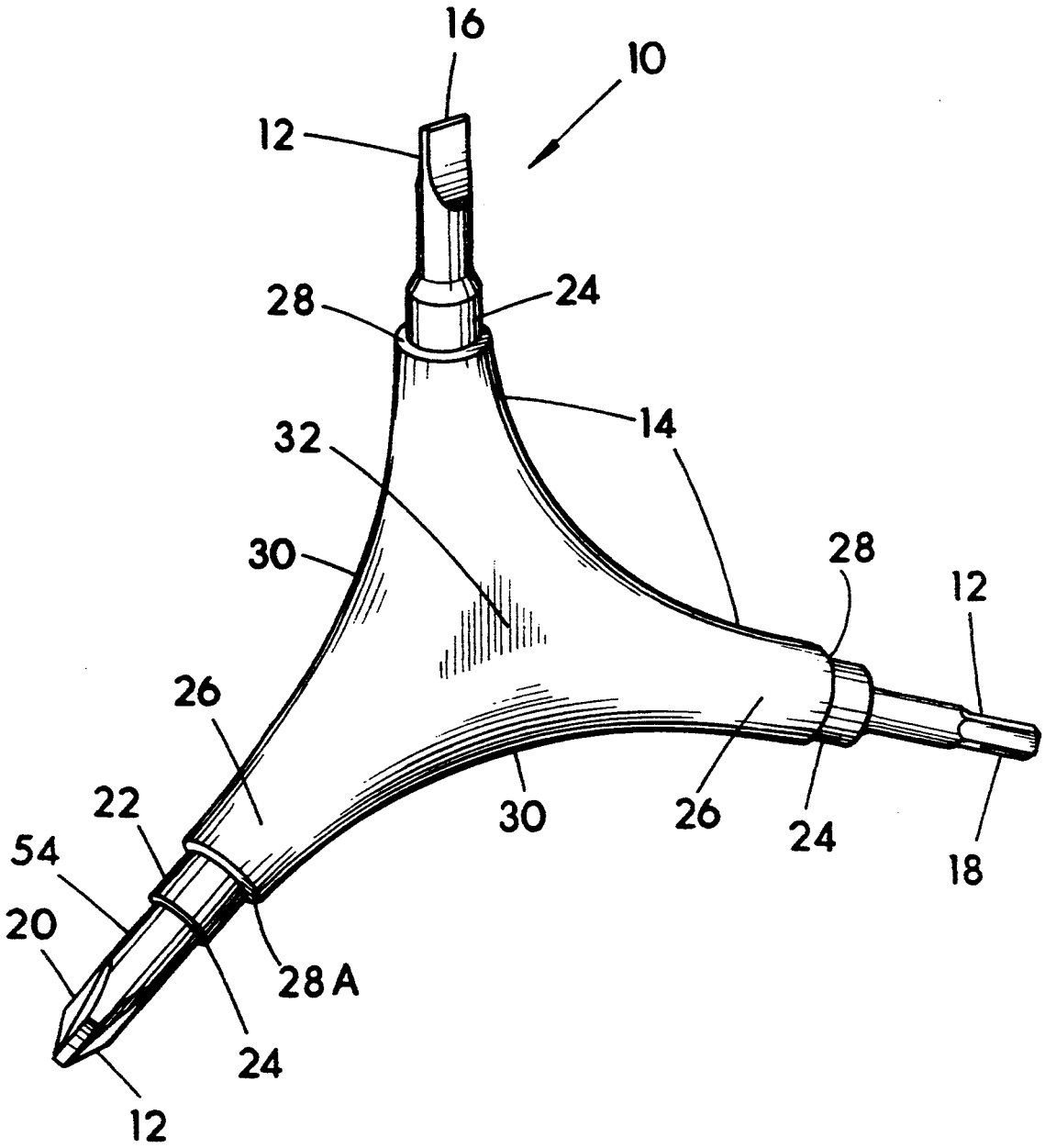
FIG. 2 is a perspective of thereof.

Referring now to the drawings where a preferred embodiment of my in-line skate tool 10 is illustrated. My in-line skate tool 10 includes four tools essentially incorporated into three metal tool tips 12 which are affixed to a common central plastic handle 14. The tool tips 12 includes a flat head screw driver 16, a hex key 18, and a phillips screw driver 16 with a bearing pusher 22, which are all sized to shaped to the majority of existing in-line skates in use today. Therefore, flat head screw driver 20 is preferably ¼ in size, with hex key 18 preferably being 5/32". Phillips screw driver 20 should be sized #2, with bearing pusher 22 being approximately 5/16" in diameter at the first shoulder 22, and about 3/8" in diameter at the second shoulder 28A. Bearing pusher 22 and the first shoulder 22 of bearing pusher 22 are one and the same in this disclosure. The first shoulder of the bearing pusher 22 is actually integrally incorporated into the same tool tip 12 adjacent phillips screw driver 20, and the first shoulder of the bearing pusher 22 is a slightly widened right angled shoulder located a short distance inward from the distal end of tool tip 12. Bearing pusher 22 also functions in conjunction with the second pushing shoulder 28A, which will be described later. The specific sizes given are of course the preferred sizes given for example, and could be altered somewhat within the scope of the invention.

Figure 3:
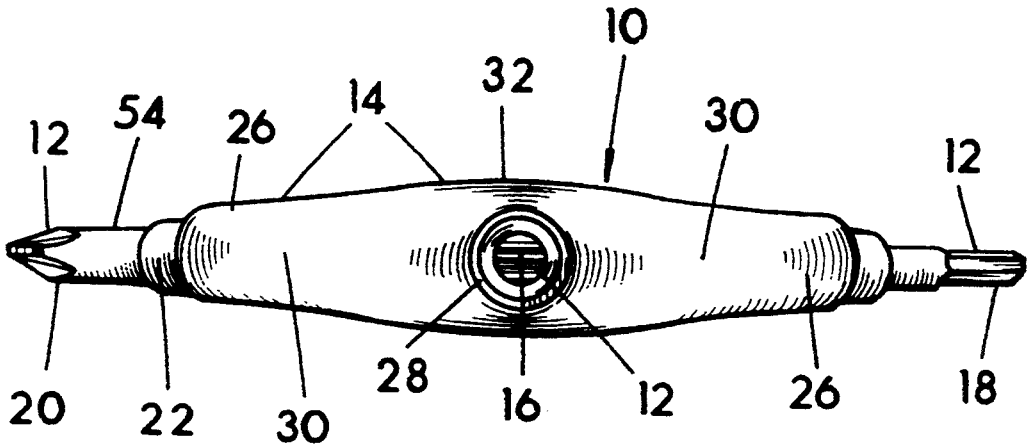
FIG. 3 is a top plan view thereof.
Figure 4:
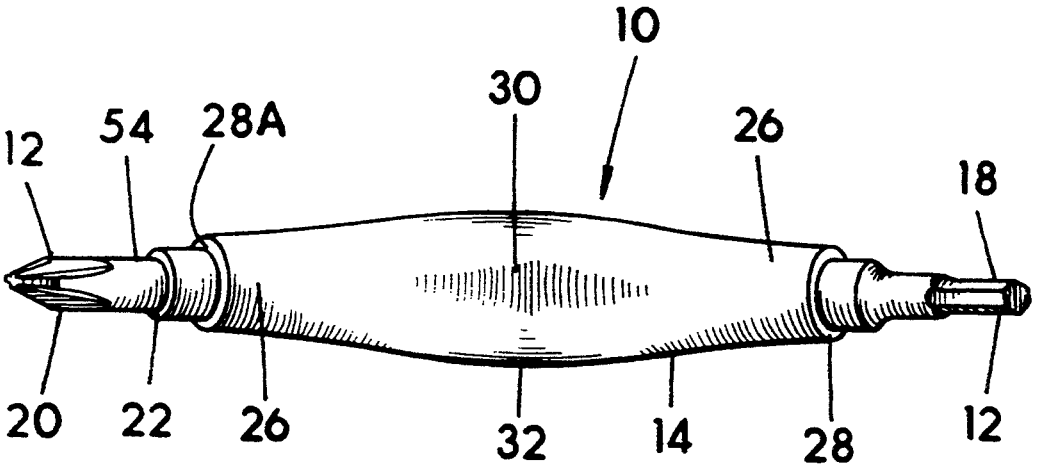
FIG. 4 is a bottom plan view thereof.

Handle 14 is generally structured in the form of an equilateral three pointed or three armed star, as is the overall finished tool 10, with the rounded arms 26 terminating in flattened ends 28 of which one is the second shoulder 28A of the bearing pusher, and the sides 30 of the handle 14 are inwardly curved, as shown in FIG. 1. When viewed endwardly, as shown in FIGS. 3 and 4, handle 14 is slightly raised or thickened in the center of the main body 32 to provide reinforcement in holding of the rods with tips 12, and the sides 30 of handle 14 taper slightly downward to the rounded arms 26 and to ends 28 to where tool tips 12 are affixed. The flattened end 28A positioned adjacent bearing pusher 22 is referred to as the second shoulder 28A and is a right angled lip or shoulder for purposes of removing wheel bearings 44, the process of which will later be described in detail. The other two flattened ends 28 need not be right angled but could instead be beveled or rounded edges or lips, however for the purposes of simplifying this disclosure and the manufacturing of the tool 10, all ends 28 have been depicted as right angled edges.

Handle 14, although small, fits comfortably into the user's hand. When in use, two of the arms 26 of handle 14 provide sufficient leverage for exerting significant torque on the third tool tip 12 being used. When holding the tool 10 in the hand for using one of the tool tips, one tool tip is positioned in the palm of the hand, and a second tool tip is positioned extending out of the hand between the thumb and index finger, with the third tool tip, the tip which is to be used, positioned extending outward between the index and middle fingers. Handle 14 is preferably manufactured of a high impact ABS plastic material, although other suitably durable and rigid materials could be used. The plastic of handle 14 must be hard enough to resist torque but not too hard that it will be brittle and prone to shattering. The metal of which tool tips 12 are comprised is preferably a hardened tool steel such as rust resistant chrome vanadium steel, although other suitably strong materials are acceptable.

Figure 5:
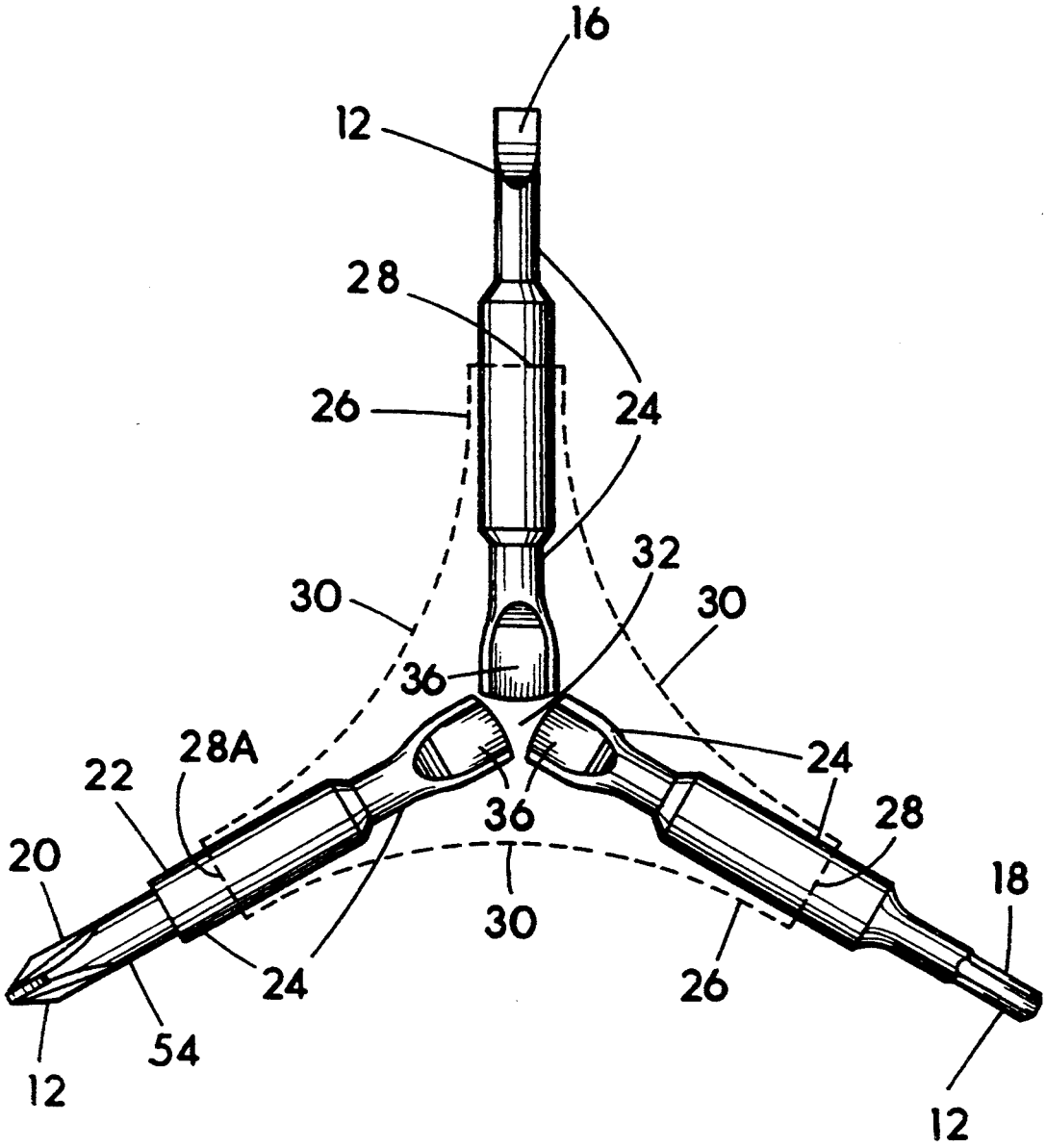
FIG. 5 is a front elevation view showing each of the tools as separate units prior to the shooting or molding of the plastics to define the plastic handle, which depicted in the dotted outline.

Initially during manufacturing, each tool tip 12 is inherently formed onto one end of a short cylindrical metal rod 24, with the majority of each metal rod 24 later to be housed within the arms 26 of handle 14. The attachment ends 36 of metal rods 24, opposite to tool tips 12, are flattened which results in a slight widening in the flattened ends 36 allowing for a secure anchoring of the metal rods 24 within main body 32 of handle 14, as shown in FIG. 5, and this prevents rotation of each tool tip 12 due to excessive torquing. The flattened and slightly widened shape of attachment ends 36 provides wide surface areas onto which the rigid plastic of the handle 14 is molded, and these wide surface area contacts between the ends 36 and the plastic of handle 14 provides an arrangement which, for all practical purposes, assures metal rods 24 will not spin or rotate within the plastic handle 14 even under extreme fastener tightening operations. Each metal rod 24 is positioned radially about the center point of main body 32, with each of the three attachment ends 36 positioned adjacent one another, and with tool tips 12 extending outward from the surface of the flattened ends 28 of each arm 26. The distal ends of the tool tips 12 are preferably affixed equidistance from one another and essentially lying in the same plane to render the tool 10 generally flat, as may be ascertained from the drawings.

The best method of manufacturing in-line skate tool 10 is to shoot or mold the plastic handle 14 around the three metal rods 24, preferably using thermoplastic injection molding techniques. The three separate metal rods 24 are inserted into the handle mold cavity prior to injection of the plastic, and can be retained in position with pressure fittings, mechanical retainers or even magnets provided metal rods 24 are comprised of ferrous materials. The plastic material is then injected around attachment ends 36 of rods 24 to form handle 14. This plastic injection molding method is quick, relatively inexpensive, and helps provide an extremely durable and inexpensive tool 10.

All in-line skates have a removable bolt arrangement which serves as an axle for retaining each of the urethane wheels 38 onto the skate. Occasionally, wheels 38 need to be rotated or replaced, and the retaining axle must first be removed. The head of this bolt or axle on the majority of skates, is structured to be manipulated with a hex key 18, flat head screw driver 16, or a phillips screw driver 20. Therefore, the combination of these three tool tips 12 are structured to service all of the majority of in-line skates in use today.

Figure 6:
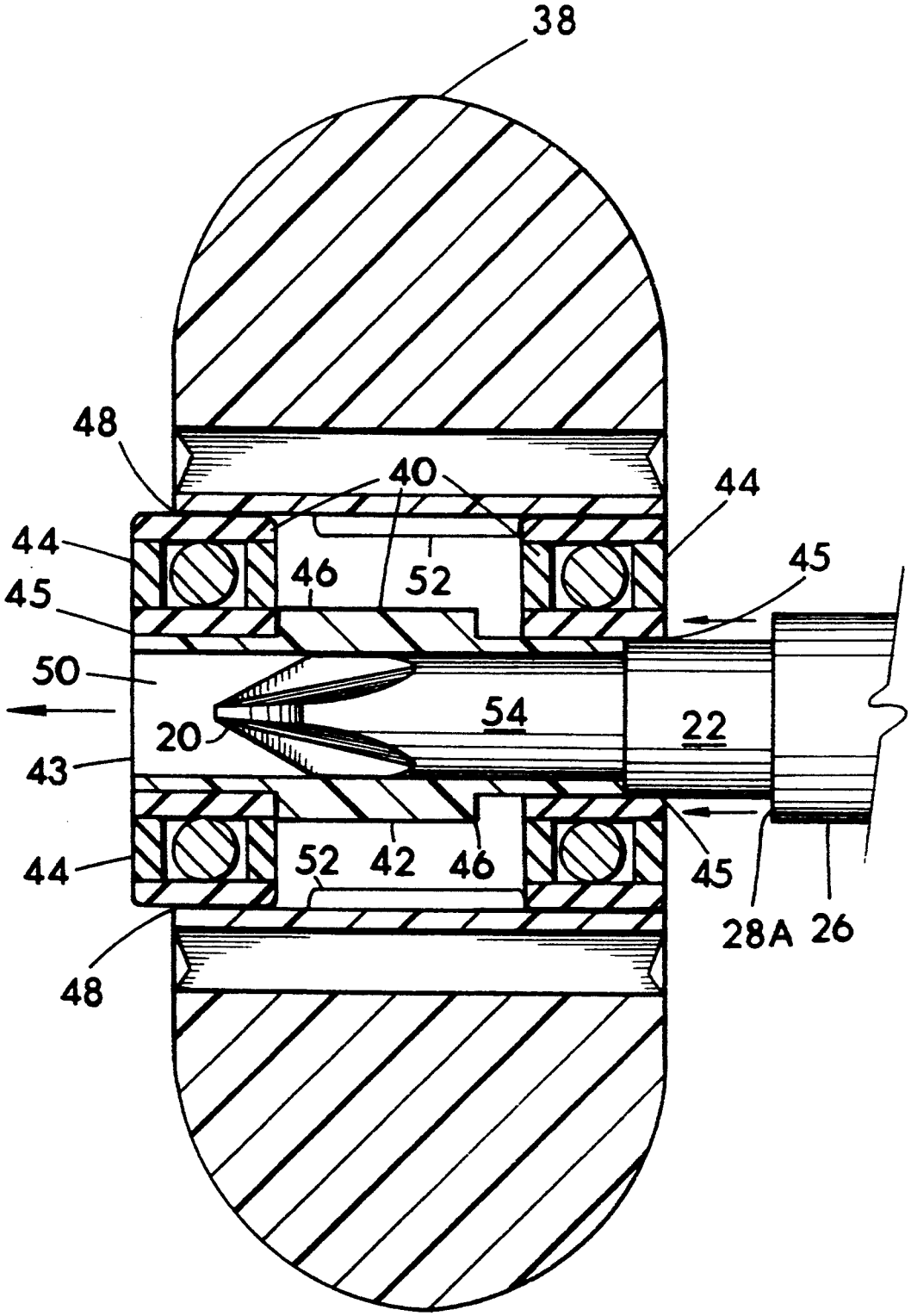
FIG. 6 is an enlarged cross-sectional view taken through the center of a wheel and wheel bearing assembly, showing the bearing pusher in use dislodging the left side bearing by pushing against an internal bearing spacer. A first bearing pushing shoulder of my tool is shown pressing against the end of the internal bearing spacer which is pressing-out the left side wheel bearing. The shaft adjacent the phillips screw driver tip is shown within the bearing spacer and stabilizing the bearing pusher shoulder against lateral movement.

Most wheels 38 of in-line skates have a three piece bearing assembly 40 comprised of a central bearing spacer 42 made of either plastic or metal onto which is removably affixed two metal bearings 44. Bearing spacer 42 is a short hollow cylindrical sleeve having two terminal ends 43 sized for frictional insertion into the central openings 45 of each bearing 44. Each bearing 44 is separated from one another on spacer 42 by a small raised shoulder 46 located on the central exterior surface of spacer 42. Central shoulder 46 helps maintain bearings 44 in position when in use and also helps in the removal of bearings 44 from wheel 38. Bearing assembly 40 is sized for frictional insertion into the central opening or hub 48 of wheel 38. The hollow central opening or bore 50 of spacer 42 is structured for placement over the axle which retains wheel 38 onto the skate. Another feature which helps to maintain each bearing 44 in position when in use and prevent movement into the interior of hub 48, is a narrow raised shoulder or stop 52 located in the center of hub 48, as shown in FIG. 6.

Figure 7:
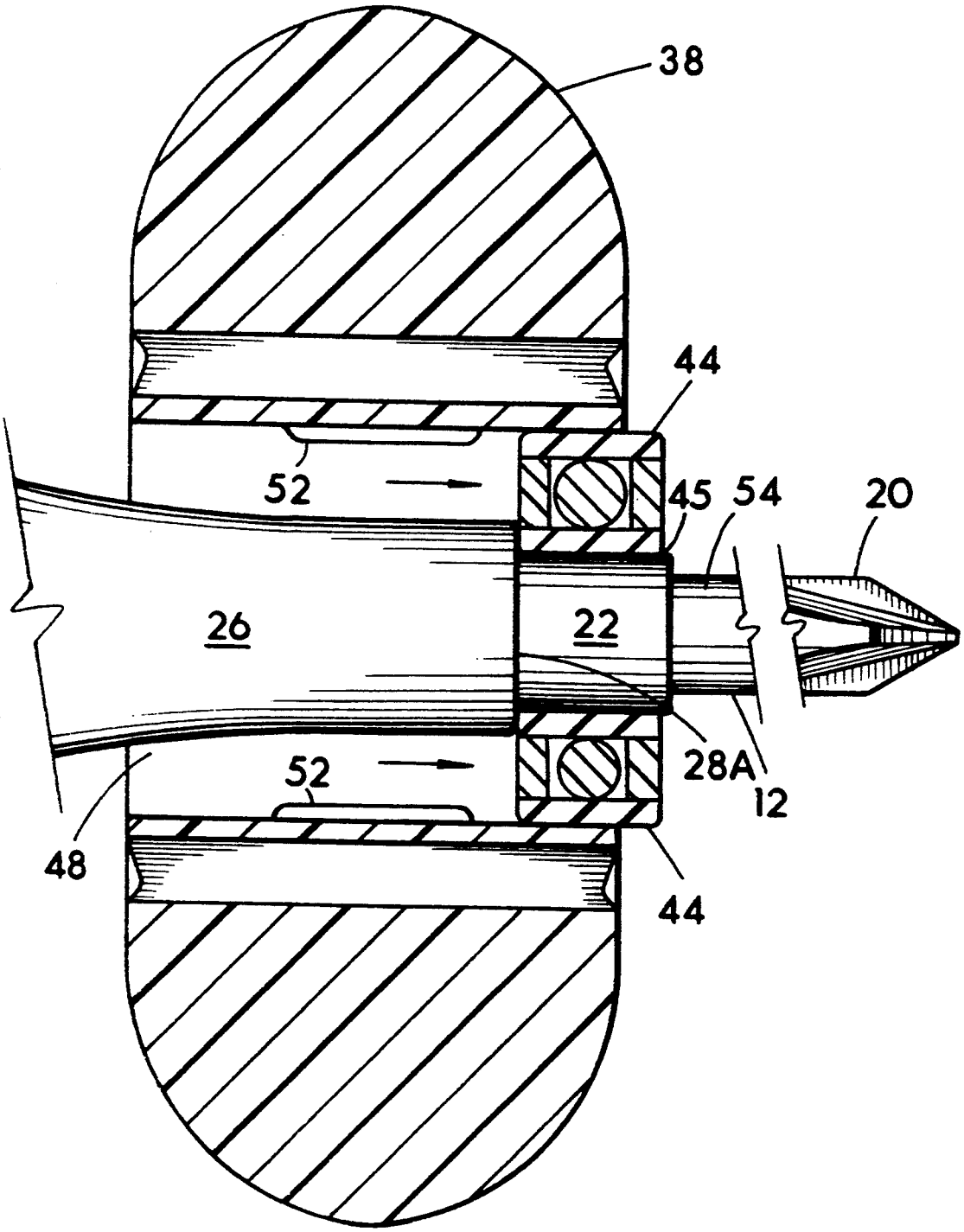
FIG. 7 is an enlarged cross-sectional view taken through the center of a wheel and wheel bearing, showing the right side bearing being removed by insertion of the bearing pusher from the opposite side of the wheel. A second bearing pushing shoulder of my tool, which is defined by the plastic terminal end of the arm of the handle, is shown pressing against the left side wheel bearing. The enlarged shaft portion which defines the first bearing pushing shoulder adjacent the smaller shaft supporting the phillips screw driver tip is shown within the center of the wheel bearing and stabilizing the second bearing pusher shoulder against lateral movement.

Bearings 44 usually out-last the urethane wheels by quite some time, and the urethane wheels usually need to be replaced before the bearings 44, and so bearings 44 are typically removed from the old wheels and inserted into new wheels. When the wheels need replacement, the wheel axle must first be removed to detach wheel 38 from the skate. Bearing assembly 40 is merely retained within hub 48 by a pressure fit, and a specially sized tool is required to push bearing assembly 40 out from engagement with wheel 38. This specialized tool or bearing pusher 22 is a widened right angled shoulder on the exterior of metal rod 24 adjacent phillips screw driver 20, which is substantially equal in diameter to terminal ends 43 of bearing spacer 42. The shaft of phillips screw driver 20 also serves as a guide pin 54 which is specifically sized for snug but movable insertion into bore 50 of spacer 42. Guide pin 54 helps to prevent racking of bearing pusher 22 which could cause binding of bearings 44 which may eventually adversely effect its performance. To remove bearings 44, guide pin 54 is advanced into bore 50 until the widened shoulder of bearing pusher 22 abuts the end of spacer 42, as shown in FIG. 6. As bearing pusher 22 pushes against the end 43 of spacer 42, the edge of central shoulder 46 on the exterior of spacer 42 abuts the inside edge of the bearing 44 on the opposite side of wheel 38 and pushes it completely out of hub 48. Bearing pusher 22 is of sufficient length to ensure that all of the first bearing 44 is ejected out of hub 48 before second shoulder 28A of arm 26 abuts the outside edge of the second bearing 44. The remaining second bearing 44 cannot be removed with spacer 42 and the first bearing 44 due to stop 52 located on the interior of hub 48. Therefore, to remove the second half of bearing 44, phillips screw driver 20 is withdrawn and wheel 38 turned over. Phillips screw driver 20 is then reinserted into hub 48 through the central opening 45 of the second bearing 44. The exterior surface of bearing pusher 22 now serves as a guide shaft since guide pin 54 is of smaller diameter than the central opening 45 of the bearing 44. Bearing pusher 22 is advanced within opening 45 until the right angled second shoulder 28A abuts the interior edge of bearing 44, as shown in FIG. 7. The flattened second shoulder 28A of arm 26 is specifically sized for engagement with the edge of bearing 44, and is structured for pushing the second bearing 44 out from hub 48. The plastic material of which handle 14 is manufactured is sufficiently rigid and durable to allow second shoulder 28A to effectively serve as a secondary part of bearing pusher 22 without deforming or loosing its right angled edge. The exterior diameter of arm 26 is sufficiently small to be inserted far enough into hub 48 to allow the pushing out of bearing 44 from hub 48.

To place the old bearings 44 into new wheels, one of the bearings 44 is inserted over one end 43 of spacer 42 and inserted into the hub of a new wheel, with the free end 43 inserted first. The second half of bearing 44 is then inserted into the wheel hub and over the second end 43 of spacer 42 on the opposite side of wheel.

Although not illustrated, bearing pusher 22 can also be incorporated onto the shafts of one or all of the other tool tips 12. However, while hex key 18 would function as a guide pin 54, its narrower diameter could cause uneven force against the edges of bearings 44 and spacer 42 which may cause racking and possible binding. Therefore, to function efficiently as guide pins 54, hex key 18 and flat head screw driver 20 would preferably be of sufficient diameter to fit relatively snugly within bore 50 of spacer 42. However, at least the distal end of hex key 18 would necessarily remain 5/32".

Although I have described a specific embodiment of my invention in detail in the specification, the specific embodiment is to be viewed as an example of one possible structure of my invention, with the invention being depicted by the appended claims.

What I claim as my invention:

1. A multipurpose hand tool structured for use with in-line roller skates, comprising;

a substantially rigid and hard handle made of plastics and having three generally rounded arms made of said plastics and positioned radially about a center of said handle and positioned so as to render said tool generally flat, each of said arms having a terminal end, at least one said terminal end of one said arm structured as a first abutment shoulder useful for pushing on a wheel bearing of an in-line roller skate to remove the bearing from the wheel, said center of said handle having curved side walls which taper into said arms so as to provide a comfortable grip for a human hand;

a first metal rod, a second metal rod, and a third metal rod;

each of the metal rods having an attachment end and an exposed oppositely disposed distal end, the attachment ends of the metal rods tightly encased within the plastic of said handle with the distal ends extending from said arms, one said rod per said arm, rotation preventing means on the attachment ends of the metal rods for preventing the metal rods from spinning within said plastics of said handle, the distal end of said first metal rod structured into a flat head screw driver;

the distal end of said second metal rod structured into a hex key;

the distal end of said third metal rod structured into a phillips screw driver, said third metal rod affixed within and extending from the arm of said handle having said first abutment shoulder, said third metal rod further including a second abutment shoulder formed onto an outer surface of said third metal rod, said second abutment shoulder positioned between said phillips screw driver and said first abutment shoulder, said second abutment shoulder having means for pressing against a center spacer of a wheel bearing assembly of an in-line roller skate, a first shaft portion of said third metal rod supporting said phillips screw driver forming a stabilizing guide shaft means during use of said second abutment shoulder, said first abutment shoulder including means for pressing against a wheel bearing with said second abutment shoulder inserted within a center opening of the wheel bearing and serving as a guide and lateral stabilizer for said second abutment shoulder.

* * * * *

UNITED STATES PATENT AND TRADEMARK OFFICE

CERTIFICATE OF CORRECTION

PATENT NO. : 5,365,811

DATED : November 22, 1994

INVENTOR(S) : Clive S.H. Chi

It is certified that error appears in the above-indentified patent and that said Letters Patent is hereby corrected as shown below:

On the title page, item [76], change "Clive H. Chi" to --Clive S.H. Chi--

Signed and Sealed this

Twenty-fourth Day of January, 1995

*Attest:*

Bruce Lehman

BRUCE LEHMAN

*Attesting Officer*

*Commissioner of Patents and Trademarks*